US011209005B2

(12) United States Patent
Wang et al.

(10) Patent No.: US 11,209,005 B2
(45) Date of Patent: Dec. 28, 2021

(54) PRESSPROOF FAN STRUCTURE

(71) Applicant: ASIA VITAL COMPONENTS CO., LTD., New Taipei (TW)

(72) Inventors: Te-Chung Wang, New Taipei (TW); Ming-Che Lee, New Taipei (TW); Min-Sheng Cheng, New Taipei (TW); Tien-Lung Yu, New Taipei (TW)

(73) Assignee: Asia Vital Components Co., Ltd., New Taipei (TW)

( * ) Notice: Subject to any disclaimer, the term of this patent is extended or adjusted under 35 U.S.C. 154(b) by 65 days.

(21) Appl. No.: 16/686,212

(22) Filed: Nov. 18, 2019

(65) Prior Publication Data

US 2021/0148369 A1 May 20, 2021

(51) Int. Cl.

| | |
|---|---|
| ***F04D 19/00*** | (2006.01) |
| ***F04D 29/32*** | (2006.01) |
| ***F04D 29/52*** | (2006.01) |

(52) U.S. Cl.

CPC ..... *F04D 19/002* (2013.01); *F04D 29/325* (2013.01); *F04D 29/522* (2013.01)

(58) Field of Classification Search

CPC ..... F04D 19/002; F04D 24/0505; F04D 25/0613; F04D 29/325; F04D 29/4226; F04D 29/522

See application file for complete search history.

(56) References Cited

U.S. PATENT DOCUMENTS

| | | | | |
|---|---|---|---|---|
| 2006/0002081 | A1* | 1/2006 | Hongo | G06F 1/203 361/691 |
| 2007/0048125 | A1 | 3/2007 | Chou | |
| 2009/0196770 | A1 | 8/2009 | Yu et al. | |
| 2013/0099613 | A1* | 4/2013 | Cheong | G11B 19/2009 310/90 |
| 2013/0194701 | A1* | 8/2013 | Fukushima | H02K 5/1675 360/99.08 |
| 2015/0043159 | A1* | 2/2015 | Tamaoka | G06F 1/203 361/679.48 |
| 2018/0100511 | A1* | 4/2018 | Tamaoka | F04D 19/002 |
| 2018/0231009 | A1* | 8/2018 | Yeh | F04D 29/626 |
| 2021/0018007 | A1* | 1/2021 | Fleig | F04D 25/06 |

FOREIGN PATENT DOCUMENTS

| | | | |
|---|---|---|---|
| CN | 202673720 | U | 1/2013 |
| CN | 202673740 | U | 1/2013 |
| CN | 202867310 | U | 4/2013 |
| CN | 262867368 | U | 4/2013 |
| TW | M417596 | U1 | 12/2011 |
| TW | 201934889 | A | 9/2019 |

* cited by examiner

*Primary Examiner* — Patrick Hamo

(74) *Attorney, Agent, or Firm* — Bradley J. Thorson; DeWitt LLP

(57) ABSTRACT

A pressproof fan structure includes: a fan frame having an upper case and a lower case; a support shaft having one end inserted into the lower case, and the other end protruding out from the upper case; an oil-retaining bearing having a bearing hole, in which the support shaft is fitted; a rotor assembly fitted around and connected with the oil-retaining bearing; a restriction member fitted around the support shaft near the oil-retaining bearing; a thrust member fitted around the support shaft near the oil-retaining bearing; and a stator assembly disposed on the lower case near the oil-retaining bearing without contacting.

14 Claims, 10 Drawing Sheets

PRESSPROOF FAN STRUCTURE

BACKGROUND OF THE INVENTION

1. Field of the Invention

The present invention relates generally to a fan, more particularly to a pressproof fan structure.

2. Description of the Related Art

It is known that cooling fans are widely mounted in electronic products such as desktop computer, notebook and tablet to provide heat dissipation function. Currently, it is a trend to design the notebook and the tablet with light weight and thin thickness. In order to meet the requirement of the current trend of light weight and thin thickness, the cooling fan is also designed to be a thin fan. However, when touching the panel or striking the keyboard, the thin fan is apt to be compressed to lead to damage of the fan blade or deformation of the flow way. In this case, the wind cannot flow out.

It is therefore tried by the applicant to provide a pressproof fan structure to solve the above problem existing in the conventional cooling fan.

SUMMARY OF THE INVENTION

It is therefore a primary object of the present invention to provide a pressproof fan structure, which is able to prevent an external unit such as a keyboard, a case or a panel from compressing the rotor assembly or the fan frame.

It is a further object of the present invention to provide the above pressproof fan structure, in which a support shaft supports a rotor assembly in a fan frame. The support shaft has a protrusion section protruding from the rotor assembly and the fan frame to bear and connect with an external unit so as to keep an axial space between the external unit and the rotor assembly. Accordingly, at least the rotor assembly is prevented from being compressed by the external unit.

It is still a further object of the present invention to provide the above pressproof fan structure, in which at least one support column is disposed in the flow way of the fan frame to support a boss on the outer surface of the fan frame so as to keep an axial space between the external unit and the fan frame. Accordingly, at least the flow way is prevented from being compressed by the external unit.

To achieve the above and other objects, the pressproof fan structure of the present invention includes: a fan frame having an upper case and a lower case, the upper case having a wind entrance; a support shaft, one end of the support shaft being inserted in one side of the lower case, the other end of the support shaft protruding out from the upper case; an oil-retaining bearing having a bearing hole, in which the support shaft is fitted; a rotor assembly fitted around and connected with the oil-retaining bearing; a restriction member fitted around the support shaft near an upper end of the oil-retaining bearing; a thrust member fitted around the support shaft near a lower end of the oil-retaining bearing; and a stator assembly disposed on the lower case adjacently around the oil-retaining bearing without contacting the oil-retaining bearing.

According to the above structure, when a depression force is created, two ends of the support shaft respective contact the operation section of the electronic device and the inner side of the case so as to prevent the depression force from being transmitted to the rotor assembly or the upper case.

Accordingly, the fan will not stop rotating or deform or damage so as to achieve pressproof effect.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
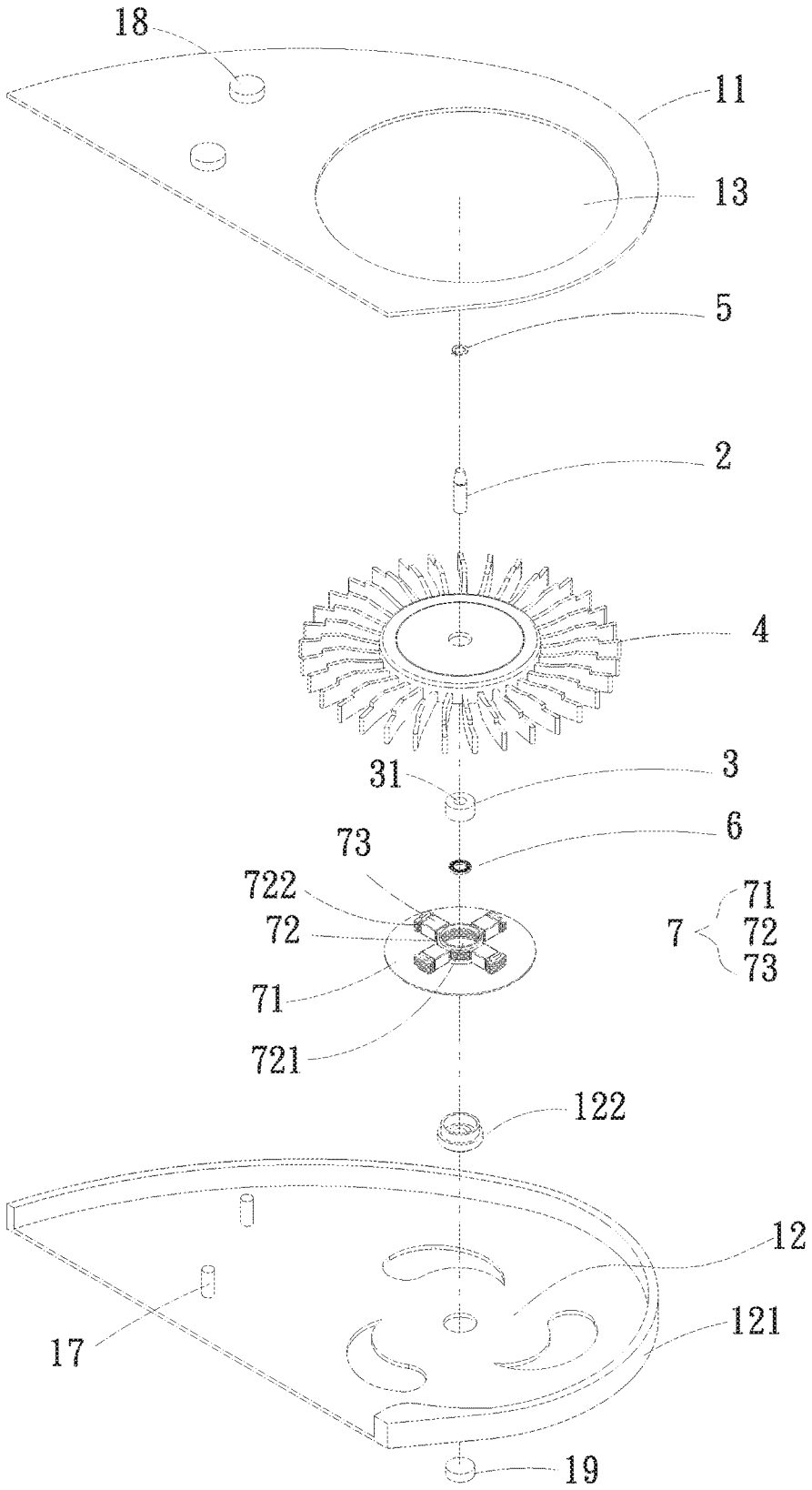
FIG. 1A is a perspective exploded view of a first embodiment of the present invention.
Figure 1B:
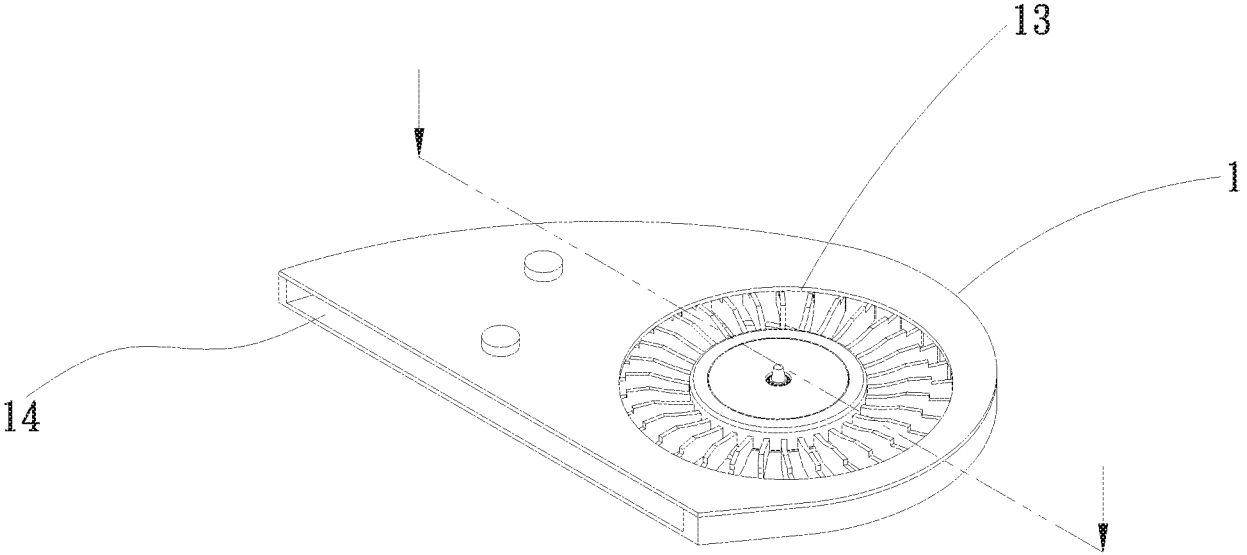
FIG. 1B is a perspective assembled view of the first embodiment of the present invention.
Figure 1C:
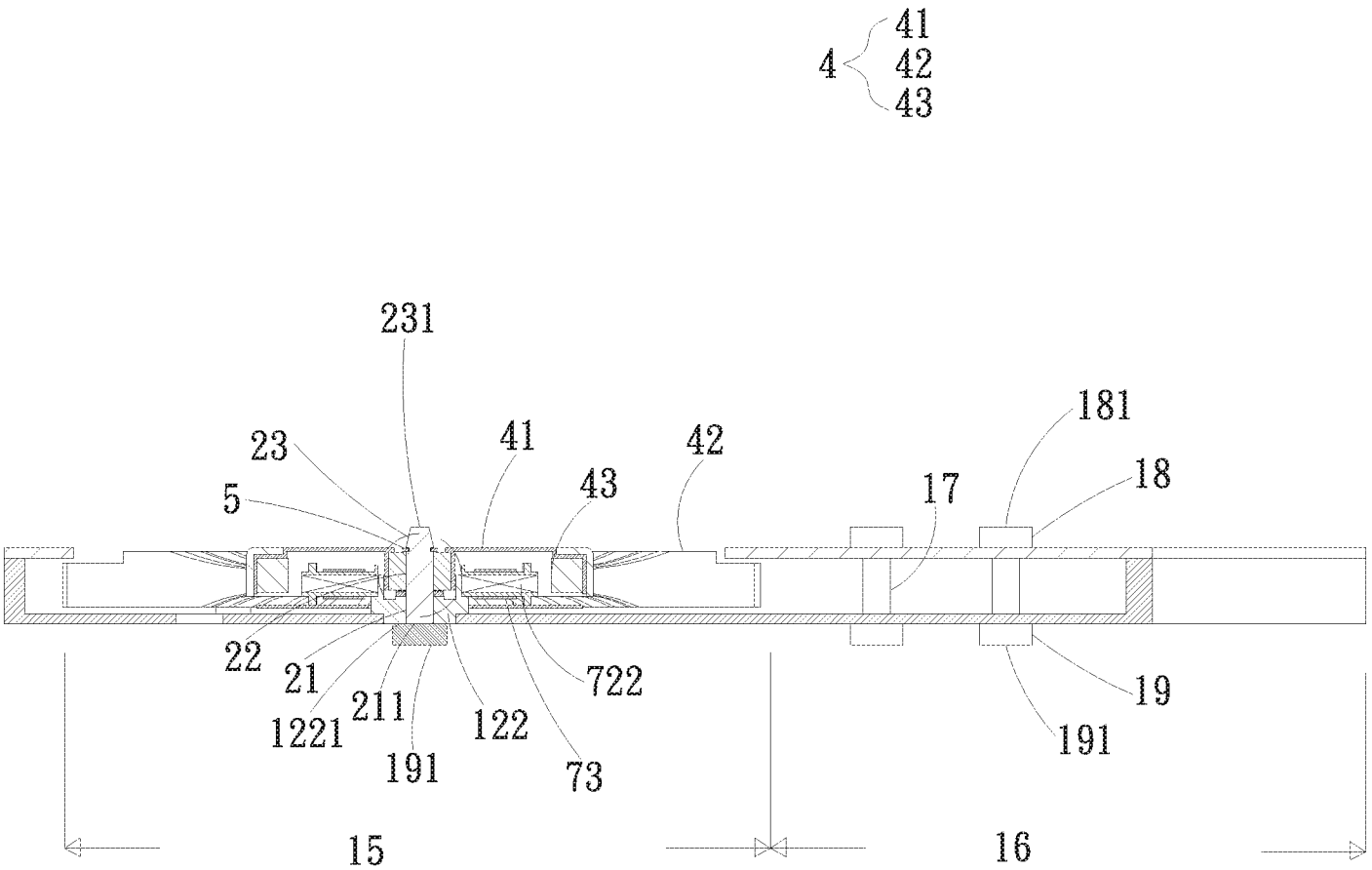
FIG. 1C is a sectional view of the first embodiment of the present invention.
Figure 1D:
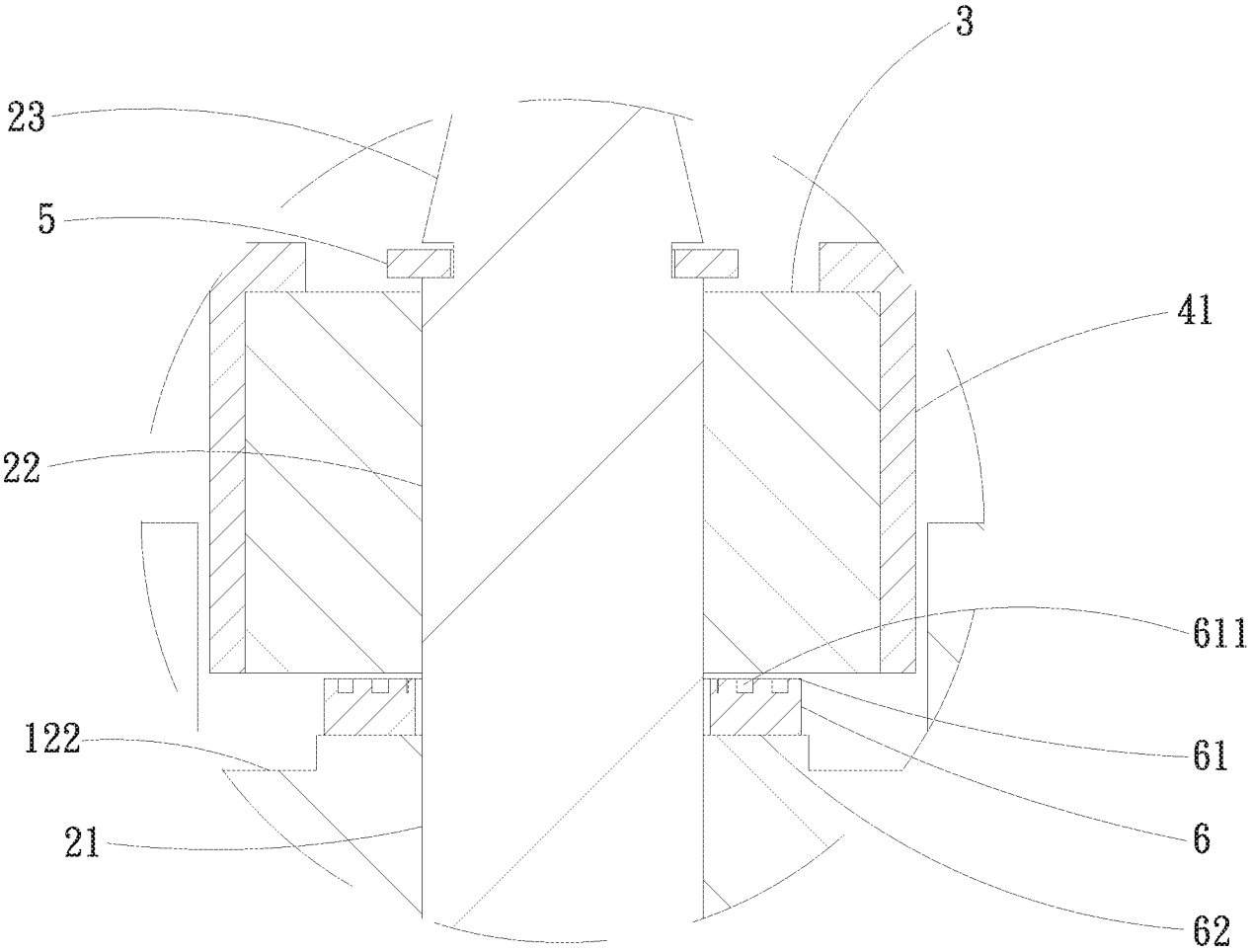
FIG. 1D is an enlarged view of circled area of FIG. 1C.

Please refer to FIGS. 1A, 1B, 1C and 1D. FIG. 1A is a perspective exploded view of a first embodiment of the present invention. FIG. 1B is a perspective assembled view of the first embodiment of the present invention. FIG. 1C is a sectional view of the first embodiment of the present invention. FIG. 1D is an enlarged view of circled area of FIG. 1C. The present invention mainly includes a fan frame 1, a support shaft 2, an oil-retaining bearing 3, a rotor assembly 4, a restriction member 5, a thrust member 6 and a stator assembly 7.

The fan frame 1 includes an upper case 11 and a lower case 12. A surrounding sidewall 121 uprightly extends from an outer edge of the lower case 12 to define a wind exit 14. A wind entrance 13 is disposed on the upper case 11. The upper case 11 and the sidewall 121 of the lower case 12 are assembled to together define a fan blade section 15 and a flow way section 16. At least one support column 17 is disposed in the flow way section 16. Two ends of the support column 17 respectively abut against and connect with the upper and lower cases 11, 12 to support the flow way section 16. The wind entrance 13 is disposed in a position in alignment with the upper side of the fan blade section 15. The lower case 12 has a base seat 122. The support shaft 2 is disposed in the base seat 122. The base seat 122 has a lower end face 1221. The stator assembly 7 is disposed around the base seat 122 in adjacency to the base seat 122.

The support shaft 2 has a connection section 21, an extension section 22 and a protrusion section 23. The connection section 21 is disposed in the base seat 122. The extension section 22 and the protrusion section 23 extend toward the upper case 11 and the protrusion section 23 protrudes from the wind entrance 13. The connection section 21 has an abutment face 211 and the protrusion section 23 has an abutment face 231.

The oil-retaining bearing 3 has a bearing hole 31, in which the extension section 22 of the support shaft 2 is fitted.

The rotor assembly 4 is fitted around and connected with the oil-retaining bearing 3. The rotor assembly 4 includes a hub 41 fitted around and connected with the oil-retaining bearing 3, multiple blades 42 respectively outward extending from outer circumference of the hub 41 and a magnetic member 43 disposed on inner circumference of the hub 41 in parallel to the stator assembly 7. The magnetic member 43 is such as an annular magnet.

The restriction member 5 is fitted on the extension section 22 of the support shaft 2 near the upper end of the oil-retaining bearing 3. The restriction member 5 is a C-shaped retainer ring or O-shaped retainer ring.

The thrust member 6 is fitted on the extension section 22 of the support shaft 2 near the lower end of the oil-retaining bearing 3. The thrust member 6 has a first face 61 and a second face 62. The first face 61 has a sink section 611. The first face 61 is directed to the oil-retaining bearing 3. The second face 62 is directed to the lower case 12.

The stator assembly 7 is disposed on one side of the lower case 12 adjacently around the oil-retaining bearing 3 without contacting the oil-retaining bearing 3. The stator assembly 7 includes a circuit board 71 and a stator main body 72 disposed on the circuit board 71 and composed of multiple silicon steel sheets, which are sequentially stacked. The stator main body 72 has a shaft hole 721 and multiple magnetic poles 722 and multiple windings 73 respectively disposed on the magnetic poles 722.

It should be noted that the oil-retaining bearing 3, the restriction member 5 and the thrust member 6 are disposed on the extension section 22. The support column 17 has two ends respectively abutting against and connecting with an inner face of the upper case 11 and an inner face of the lower case 12. In addition, an upper case boss 18 and a lower case boss 19 are respectively disposed on an outer face of the upper case 11 and an outer face of the lower case 12 corresponding to two ends of the support column 17. The upper case boss 18 has a top connection face 181 in alignment with the abutment face 231 of the protrusion section 23 of the support shaft 2. Another lower case boss 19 is disposed under the lower end face 1221 of the base seat. The abutment face 211 of the connection section 21 and the lower end face 1221 of the base seat are in contact with the lower case boss 19. The lower case boss 19 has a bottom connection face 191 in alignment with a bottom connection face 191 of the other lower case boss 19.

Figure 5:
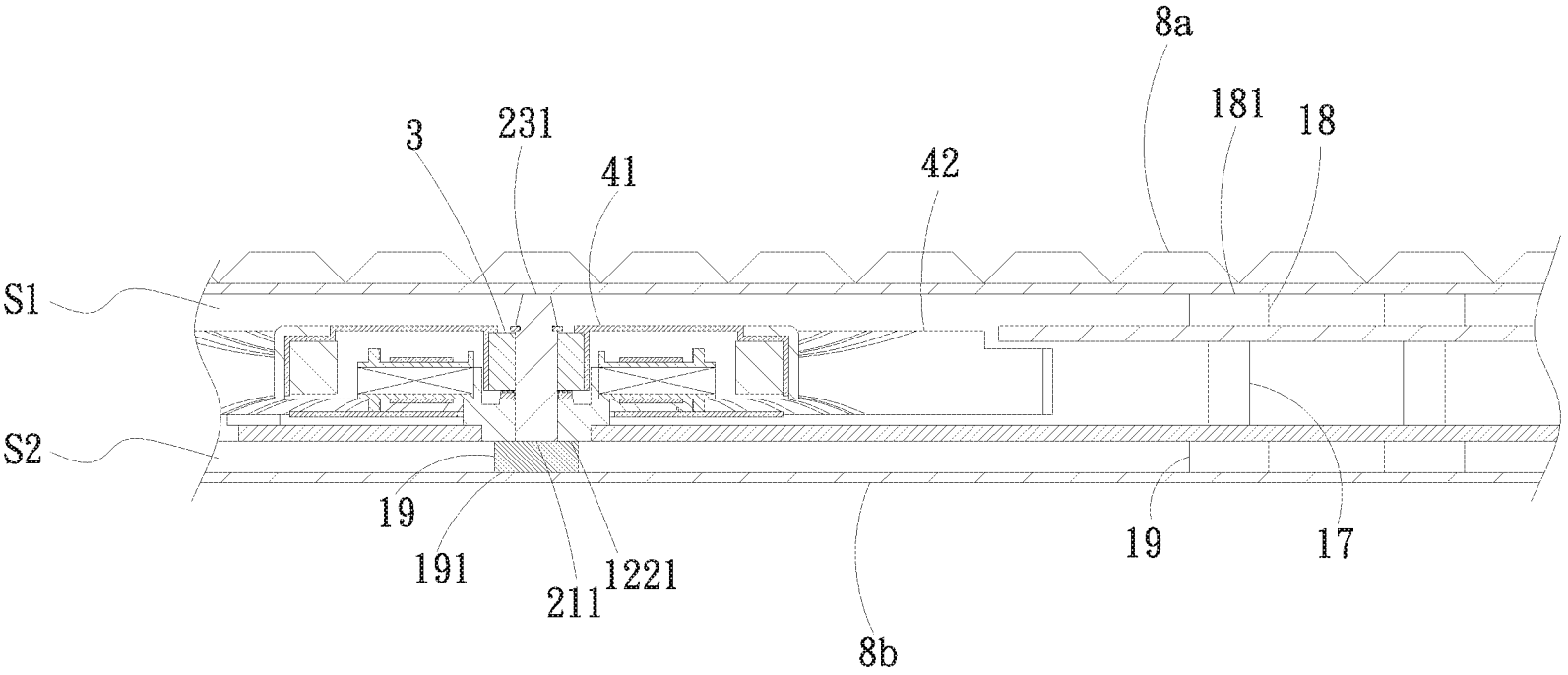
FIG. 5 is a sectional view showing that the present invention is applied to an electronic device.

Please now refer to FIG. 5, which is a sectional view showing that the present invention is applied to an electronic device. Also referring to FIGS. 1A to 1D, the fan of the present invention is disposed in an electronic device to help in dissipating the heat generated by the internal heat generation components. As shown in the drawing, the electronic device is, but not limited to, a notebook. Alternatively, the electronic device can be a tablet, a cellular phone, a handheld game or the like. An external unit 8*a* is positioned above the fan frame 10. In this embodiment, the external unit 8*a* is a keyboard. In a modified embodiment, the external unit 8*a* is a touch panel, a touch pad or a device case. The abutment face 231 of the protrusion section 23 and the top connection face 181 of the upper case boss 18 bear and connect with an external unit 8*a* to form a first axial space S1 between the external unit 8*a* and the fan frame 1. Accordingly, when a user uses the external unit 8*a* of the electronic device to create a downward pressing force, the support column 17 supports the flow way section 16 and the support shaft 2 supports the fan blade section 15 to keep the first axial space S1. When the external unit 8*a* is pressed down, the first axial space S1 provides a depression micro-deformation space in short time. Therefore, the external unit 8*a* is prevented from compressing the oil-retaining bearing 3, the hub 41 and the upper case 11 so that it is ensured that the hub 41 is free from the compression and will not stop rotating. Also, the upper case 11 will not deform to interfere with the rotation of the blades 42.

Furthermore, the lower case boss 19 abuts against another external unit 8*b* disposed under the fan frame 1. In this embodiment, the other external unit 8*b* is a device case. However, in a modified embodiment, the external unit 8*b* is a touch panel, a touch pad or a keyboard. A second axial space S2 is formed between the other external unit 8*b* and the lower case 12 of the fan frame 1. Accordingly, the other external unit 8*b* is prevented from compressing the fan blade section 15 or flow way section 16 in the fan frame 1. Therefore, the hub 41 is free from the compression and is prevented from failing to operate and/or the flow way section 16 is prevented from being compressed and deformed.

Figure 2A:
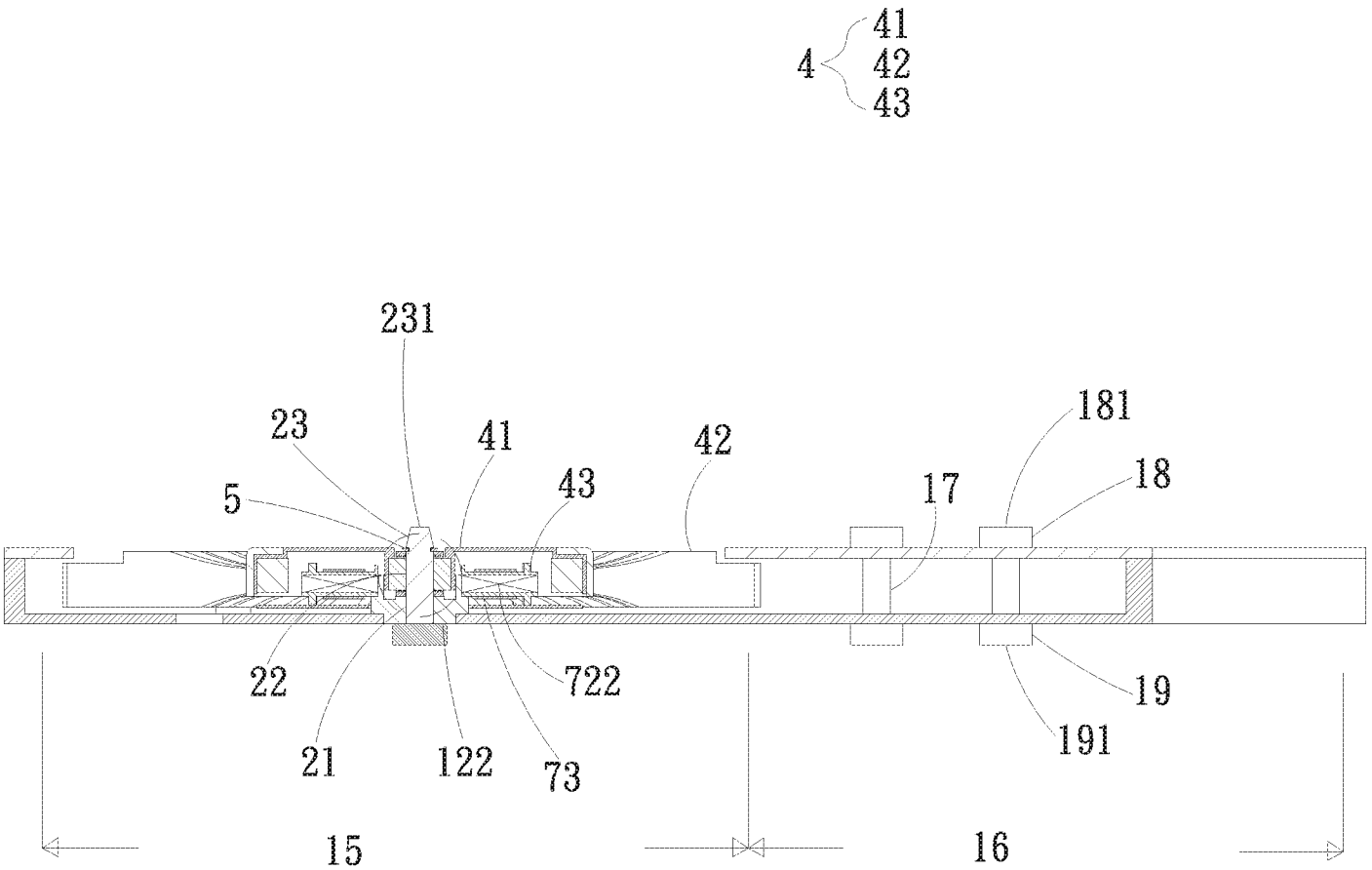
FIG. 2A is a sectional view of a second embodiment of the present invention.
Figure 2B:
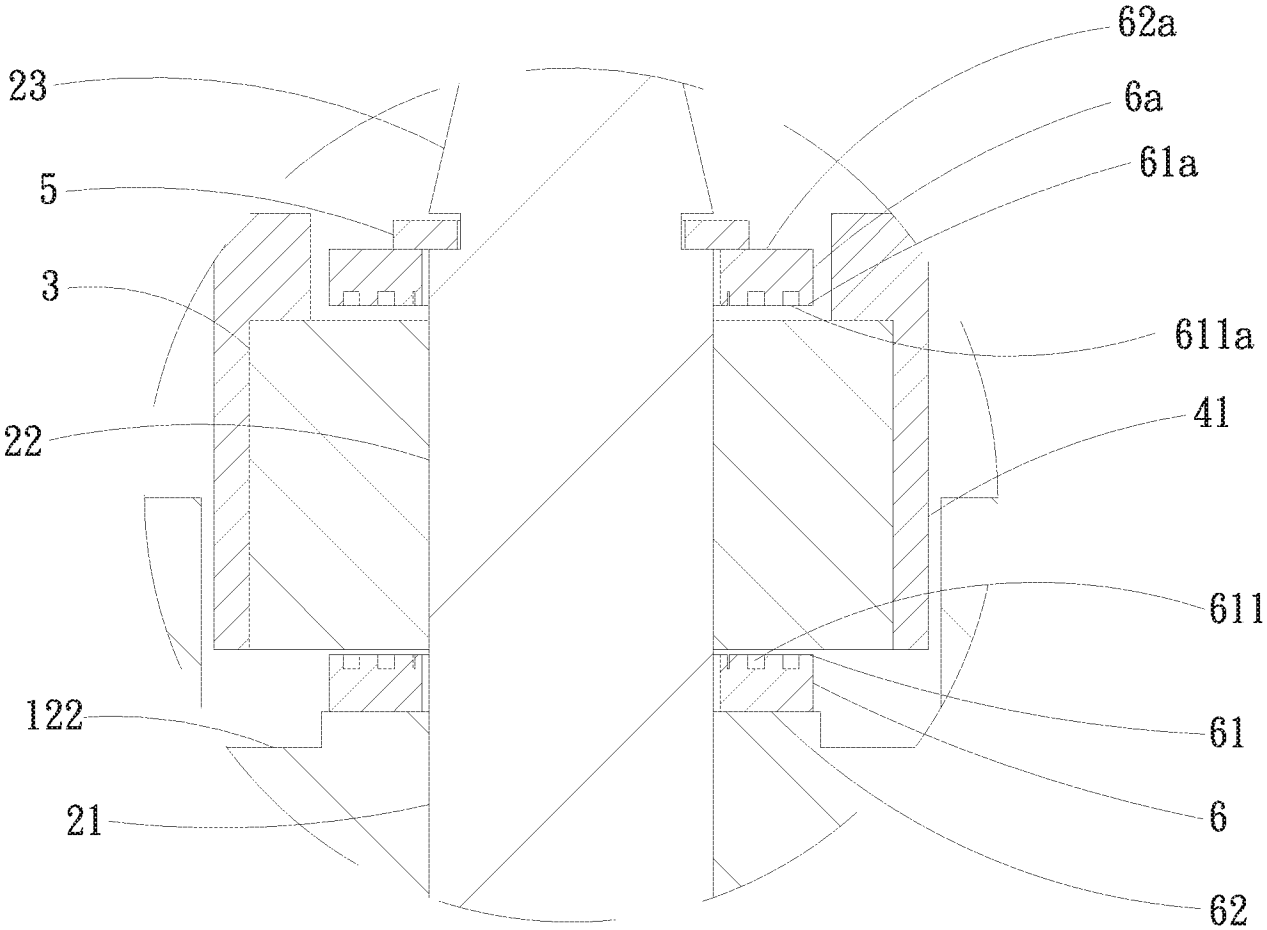
FIG. 2B is an enlarged view of circled area of FIG. 2A.

In addition, the sink section 611 is formed on the first face 61 of the thrust member 6. When rotating, the oil-retaining bearing 3 cooperates with the sink section 611 to create a fluid thrust, whereby a gap is kept between the oil-retaining bearing 3 and the thrust member 6. Therefore, when rotating, the oil-retaining bearing 3 is prevented from axially swinging along the support shaft 2 to affect the stability and the contact wear in rotation. Please now refer to FIGS. 2A and 2B. FIG. 2A is a sectional view of a second embodiment of the present invention. FIG. 2B is an enlarged view of circled area of FIG. 2A. Also referring to FIGS. 1A to 1D, the second embodiment is substantially identical to the first embodiment and the same members will not be redundantly described hereinafter. The second embodiment is mainly different from the first embodiment in that another thrust member 6*a* is disposed between the oil-retaining bearing 3 and the restriction member 5. A first face 61*a* of the thrust member 6*a* is directed to the oil-retaining bearing 3 and a second face 62*a* is directed to the restriction member 5. The first face 61*a* has a sink section 611*a*.

When rotating, the oil-retaining bearing 3 cooperates with the sink section 611 and the sink section 611*a* to create a fluid thrust, whereby a gap is respectively kept between the oil-retaining bearing 3 and the thrust member 6 and thrust member 6*a*. Therefore, when rotating, the oil-retaining bearing 3 is prevented from axially swinging along the support shaft 2 to affect the stability and the contact wear in rotation. Therefore, a two-way stability effect can be achieved.

Figure 3A:
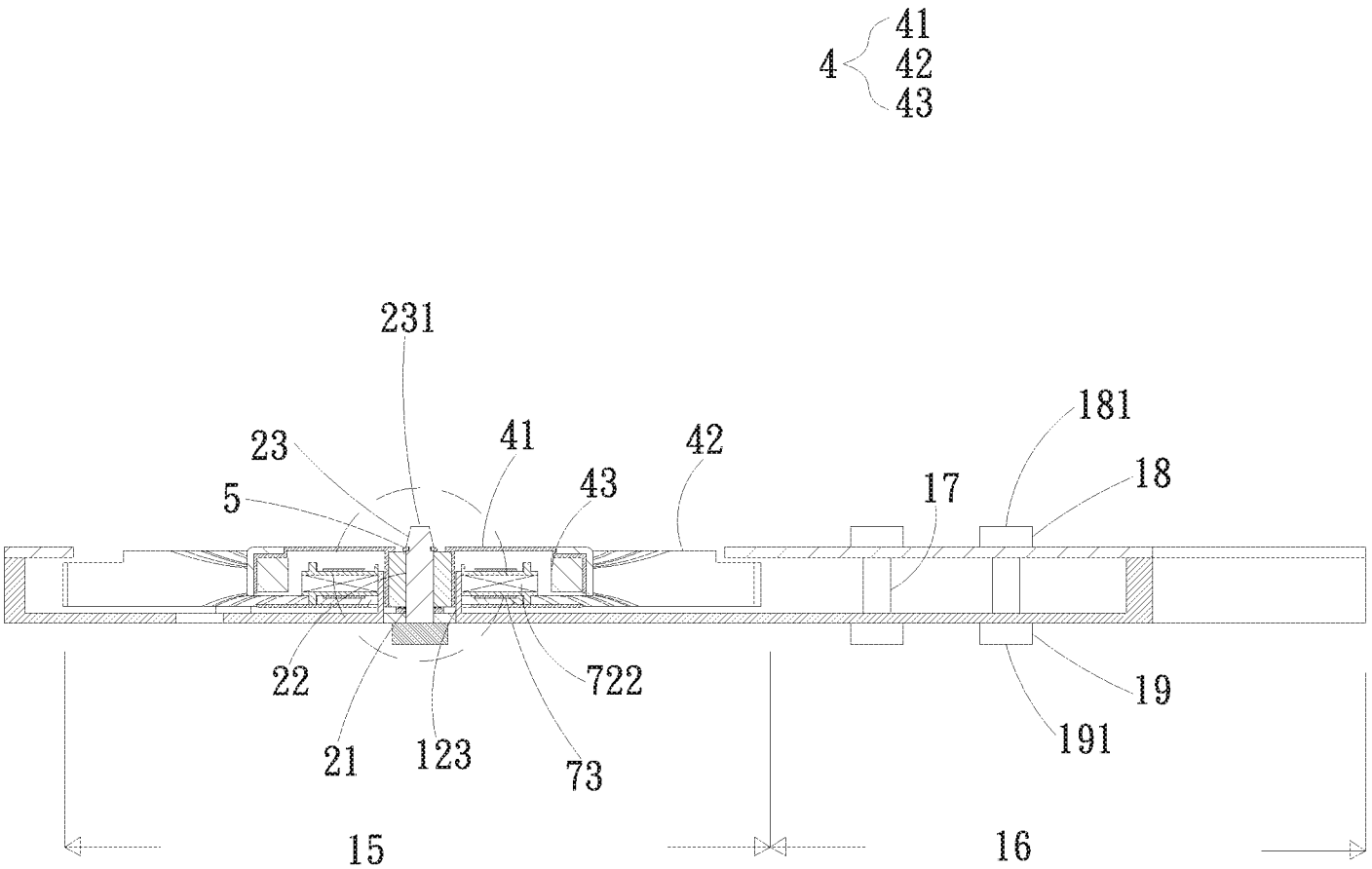
FIG. 3A is a sectional view of a third embodiment of the present invention.
Figure 3B:
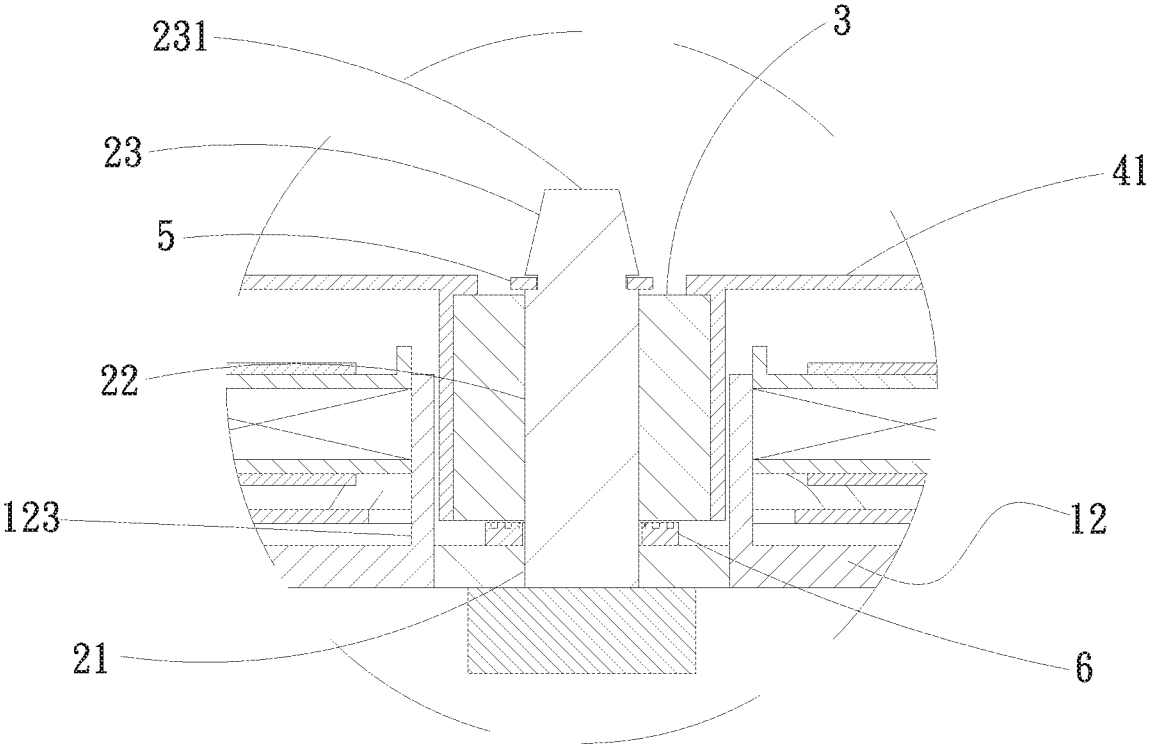
FIG. 3B is an enlarged view of circled area of FIG. 3A.

Please now refer to FIGS. 3A and 3B. FIG. 3A is a sectional view of a third embodiment of the present invention. FIG. 3B is an enlarged view of circled area of FIG. 3A. Also referring to FIGS. 1A to 1D, the third embodiment is substantially identical to the first embodiment and the same members will not be redundantly described hereinafter. The third embodiment is mainly different from the first embodiment in that the support column 17 is directly connected with the lower case 12. The lower case 12 has a bearing cup 123. The stator assembly 7 is adjacently disposed around the bearing cup 123. Therefore, the base seat 122 is omitted.

In addition, in the drawings of the third embodiment, only one thrust member 6 is employed. However, in practice, the technical feature of the second embodiment can be applied to the third embodiment. Another thrust member 6*a* (as shown in FIGS. 2A and 2B) is disposed between the oil-retaining bearing 3 and the restriction member 5 to achieve two-way stability effect.

Figure 4:
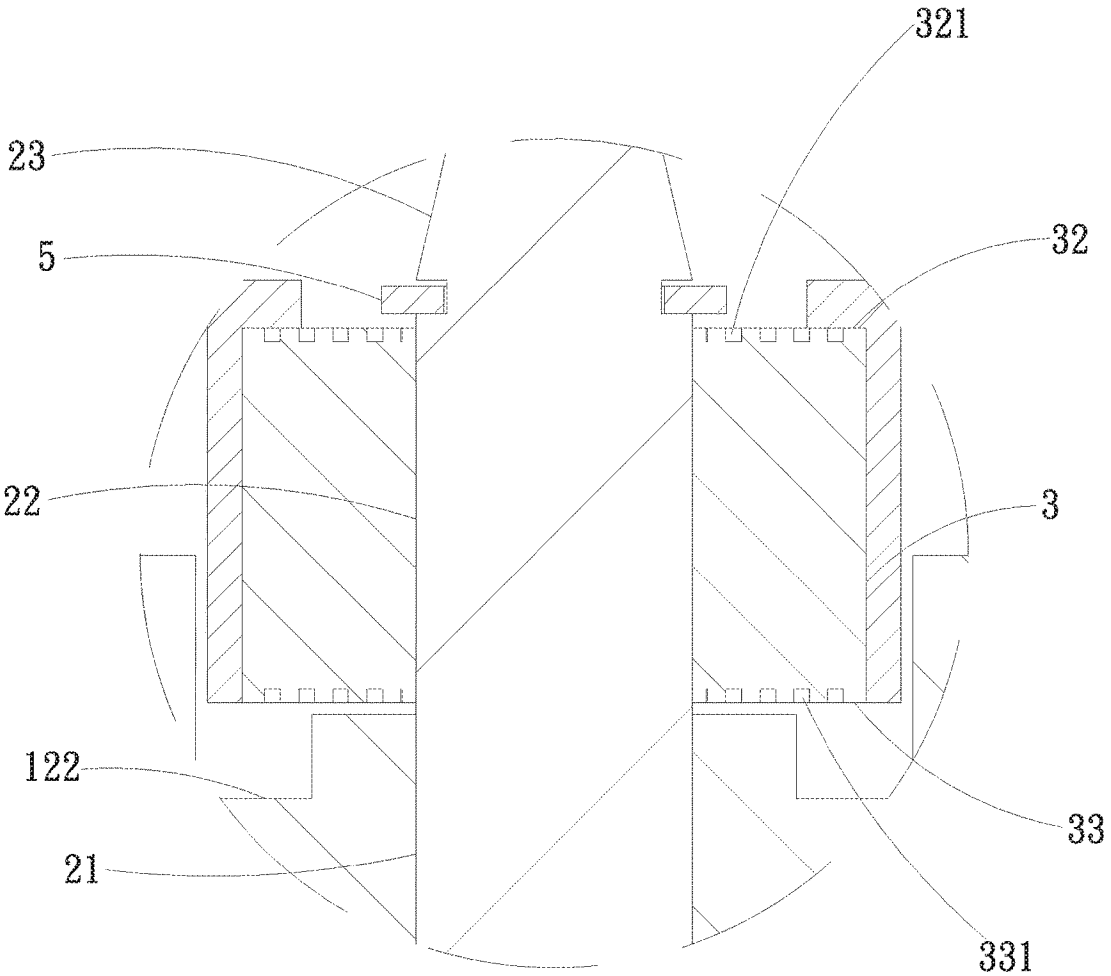
FIG. 4 is a sectional enlarged view of a part of a fourth embodiment of the present invention.

Please refer to FIG. 4, which is a sectional enlarged view of a part of a fourth embodiment of the present invention.

Also referring to FIGS. 1A to 1D, the fourth embodiment is substantially identical to the first embodiment and the same members will not be redundantly described hereinafter. The fourth embodiment is mainly different from the first embodiment in that a sink section 321 is disposed on an upper end face 32 of the oil-retaining bearing 3 and a sink section 331 is disposed on a lower end face 33 of the oil-retaining bearing 3. When rotating, the oil-retaining bearing 3 creates a fluid thrust, whereby a gap is directly kept between the oil-retaining bearing 3 and the thrust member 6 and the base seat 122. The thrust member 6 is omitted.

In addition, in the drawings of the fourth embodiment, the fan frame 1 has the base seat 122. However, in practice, the technical feature of the third embodiment can be applied to the fourth embodiment, that is, the base seat 122 is omitted.

In conclusion, the present invention has the following advantages:

1. The external unit is prevented from compressing the rotor assembly or the flow way in the fan frame.

2. The first and second axial spaces are kept between the external unit and the hub to at least prevent the rotor assembly from being compressed by the external unit.

3. The first and second axial spaces are kept between the external unit and the lower case of the fan frame to prevent the flow way from being compressed by the external unit.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A pressproof fan structure comprising:

a fan frame having an upper case and a lower case, the upper case having a wind entrance;

a support shaft, one end of the support shaft being inserted in one side of the lower case, the other end of the support shaft protruding out from the upper case;

an oil-retaining bearing having a bearing hole, in which the support shaft is fitted;

a rotor assembly fitted around and connected with the oil-retaining bearing;

a restriction member fitted around the support shaft near an upper end of the oil-retaining bearing;

a thrust member fitted around the support shaft near a lower end of the oil-retaining bearing; and a stator assembly disposed on the lower case adjacently around the oil-retaining bearing without contacting the oil-retaining bearing.

2. The pressproof fan structure as claimed in claim 1, wherein the support shaft has a connection section, an extension section and a protrusion section, the connection section being disposed on the lower case, the extension section and the protrusion section extending toward the upper case, the protrusion section protruding from the wind entrance, the oil-retaining bearing, the restriction member and the thrust member being disposed on the extension section, the protrusion section having an abutment face.

3. The pressproof fan structure as claimed in claim 2, wherein the lower case has a base seat, the connection section of the support shaft being disposed in the base seat, the stator assembly being adjacently disposed around the base seat, the base seat having a base seat lower end face.

4. The pressproof fan structure as claimed in claim 3, wherein a surrounding sidewall uprightly extends from an outer edge of the lower case to define a wind exit, the upper case and the sidewall of the lower case being assembled to together define a fan blade section and a flow way section, at least one support column being disposed in the flow way section, two ends of the support column respectively abutting against and connecting with an inner face of the upper case and an inner face of the lower case, an upper case boss and a lower case boss being respectively disposed on an outer face of the upper case and an outer face of the lower case corresponding to two ends of the support column, the upper case boss having a top connection face in alignment with the abutment face of the protrusion section of the support shaft, the abutment face of the protrusion section and the top connection face of the upper case boss bearing and connecting with an external unit to form a first axial space between the external unit and the fan frame, the lower case boss having a bottom connection face, the lower end face of the base seat and the bottom connection face bearing and connecting with another external unit to form a second axial space between the other external unit and the fan frame.

5. The pressproof fan structure as claimed in claim 4, wherein the lower case boss is disposed under the lower end face of the base seat, an abutment face of the connection section and the lower end face of the base seat being in contact with the lower case boss.

6. The pressproof fan structure as claimed in claim 1, wherein the thrust member has a first face and a second face, the first face having a sink section, the first face being directed to the oil-retaining bearing, the second face being directed to the lower case.

7. The pressproof fan structure as claimed in claim 5, wherein another thrust member is disposed between the oil-retaining bearing and the restriction member, the first face of the thrust member being directed to the oil-retaining bearing, the second face of the thrust member being directed to the restriction member.

8. The pressproof fan structure as claimed in claim 1, wherein the restriction member is a C-shaped retainer ring or an O-shaped retainer ring.

9. A pressproof fan structure comprising:

a fan frame having an upper case and a lower case, the upper case having a wind entrance;

a support shaft, one end of the support shaft being inserted in one side of the lower case, the other end of the support shaft protruding out from the upper case;

an oil-retaining bearing having a bearing hole, in which the support shaft is fitted, an upper end face and a lower end face of the oil-retaining bearing respectively having a sink section;

a rotor assembly fitted around and connected with the oil-retaining bearing;

a restriction member fitted around the support shaft near an upper end of the oil-retaining bearing; and a stator assembly disposed on the lower case adjacently around the oil-retaining bearing without contacting the oil-retaining bearing.

10. The pressproof fan structure as claimed in claim 9, wherein the support shaft has a connection section, an extension section and a protrusion section, the connection section being disposed on the lower case, the extension section and the protrusion section extending toward the upper case, the protrusion section protruding from the wind entrance, the oil-retaining bearing, the restriction member and a thrust member being disposed on the extension section, the protrusion section having an abutment face.

11. The pressproof fan structure as claimed in claim 10, wherein the lower case has a base seat, the connection section of the support shaft being disposed in the base seat, the stator assembly being adjacently disposed around the base seat, the base seat having a base seat lower end face.

12. The pressproof fan structure as claimed in claim 11, wherein a surrounding sidewall uprightly extends from an outer edge of the lower case to define a wind exit, the upper case and the sidewall of the lower case being assembled to together define a fan blade section and a flow way section, at least one support column being disposed in the flow way section, two ends of the support column respectively abutting against and connecting with an inner face of the upper case and an inner face of the lower case, an upper case boss and a lower case boss being respectively disposed on an outer face of the upper case and an outer face of the lower case corresponding to two ends of the support column, the upper case boss having a top connection face in alignment with the abutment face of the protrusion section of the support shaft, the abutment face of the protrusion section and the top connection face of the upper case boss bearing and connecting with an external unit to form a first axial space between the external unit and the fan frame, the lower case boss having a bottom connection face, the lower end face of the base seat and the bottom connection face bearing and connecting with another external unit to form a second axial space between the other external unit and the fan frame.

13. The pressproof fan structure as claimed in claim 12, wherein the lower case boss is disposed under the lower end face of the base seat, an abutment face of the connection section and the lower end face of the base seat being in contact with the lower case boss.

14. The pressproof fan structure as claimed in claim 9, wherein the restriction member is a C-shaped retainer ring or an O-shaped retainer ring.

* * * * *